United States Patent [19]

Hanger

[11] Patent Number: 4,461,127

[45] Date of Patent: Jul. 24, 1984

[54] ABRADING TOOL

[75] Inventor: Randolph T. Hanger, Seattle, Wash.

[73] Assignee: The Boeing Company, Seattle, Wash.

[21] Appl. No.: 340,130

[22] Filed: Jan. 18, 1982

Related U.S. Application Data

[63] Continuation-in-part of Ser. No. 323,017, Nov. 19, 1981.

[51] Int. Cl.[3] ..... B24D 13/04

[52] U.S. Cl. ..... 51/330; 15/230.16; 15/180

[58] Field of Search ..... 51/358, 332, 334–336, 51/354, 330, 394, 400–401; 15/179, 180, 181, 182, 183, 230.16

[56] References Cited

U.S. PATENT DOCUMENTS

| | | | |
|---|---|---|---|
| 547,827 | 10/1895 | Webster . | |
| 573,735 | 12/1896 | Webster . | |
| 1,869,564 | 8/1932 | Johnston . | |
| 1,882,769 | 10/1932 | Bugg | 51/334 |
| 2,480,739 | 8/1949 | Johnson | 51/177 |
| 2,535,637 | 12/1950 | Johnson | 51/334 |
| 2,549,043 | 4/1951 | Arthur | 51/334 |
| 2,597,421 | 5/1952 | White | 51/334 |
| 2,608,034 | 8/1952 | Fromson . | |
| 2,720,064 | 10/1955 | Klug | 51/334 |
| 2,767,526 | 10/1956 | Moran | 51/335 |
| 2,819,567 | 1/1958 | Hall . | |
| 3,357,141 | 12/1967 | Annis, Jr. . | |
| 3,605,347 | 9/1971 | Barry | 51/330 |
| 3,616,581 | 11/1971 | Johnson et al. . | |
| 3,678,529 | 7/1972 | Woods et al. | 15/180 |
| 3,696,563 | 10/1972 | Rands . | |
| 3,747,285 | 7/1973 | Block . | |
| 3,790,983 | 2/1974 | Whitsett . | |
| 3,858,367 | 1/1975 | Whitsett . | |
| 3,913,282 | 10/1975 | Whitsett . | |
| 4,037,369 | 7/1977 | Campbell | 15/180 |

FOREIGN PATENT DOCUMENTS

| | | |
|---|---|---|
| 0368980 | 10/1939 | Italy . |

*Primary Examiner*—Frederick R. Schmidt
*Assistant Examiner*—Robert A. Rose
*Attorney, Agent, or Firm*—William C. Anderson

[57] ABSTRACT

An abrading tool having, in one embodiment (280), at least one abrasive member (20) carried by a rotatable disc (285). A flexible elastomeric biasing spring (290) imparts a force upon the abrasive member (20) to urge the abrasive member (20) to a position which is substantially perpendicular to the disc (285). An adjuster (295) modifies the biasing force by changing the position at which a transverse bar (340) abuttingly contacts the biasing spring (290). The adjuster (295) eliminates the necessity of changing the rotational speed of the disc (285), abrasive characteristics of the abrasive member (20) or feed rate of the tool (280) in order to modify the sanding performance characteristics of the tool (280).

9 Claims, 29 Drawing Figures

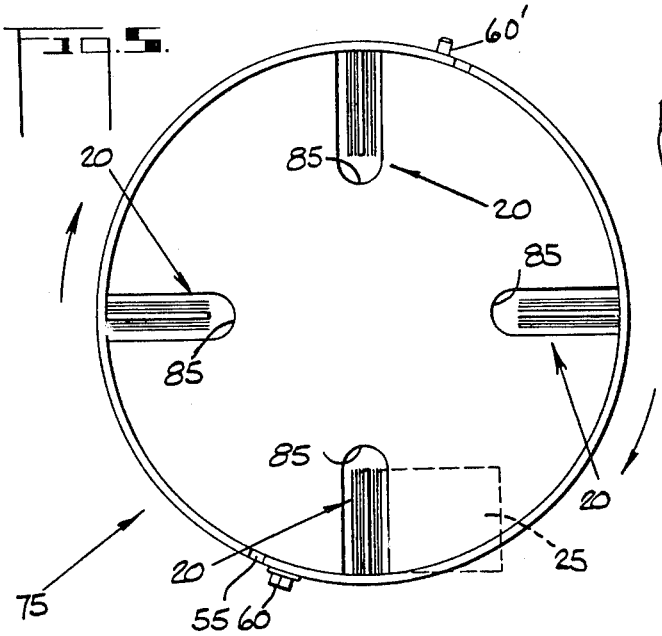
60'
20
85
20
85
85
85
20
20
25
75
55 60
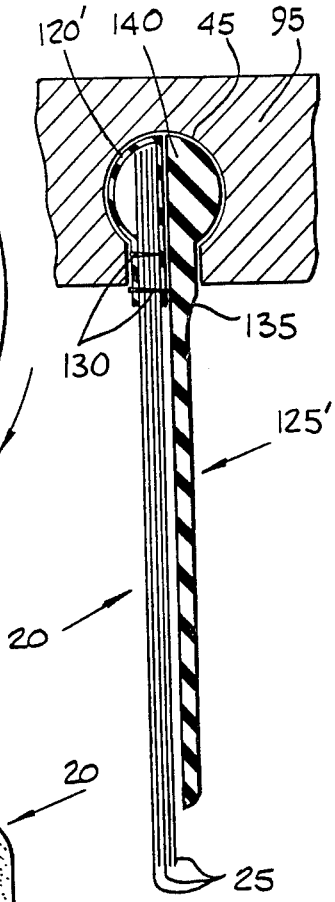
120'
140
45
95
135
130
125'
20
25
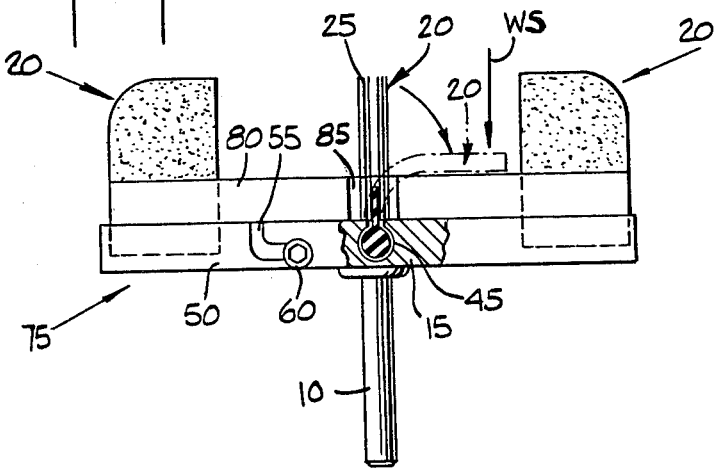
25
20
WS
20
20
20
80
55
85
50
60
45
15
75
10

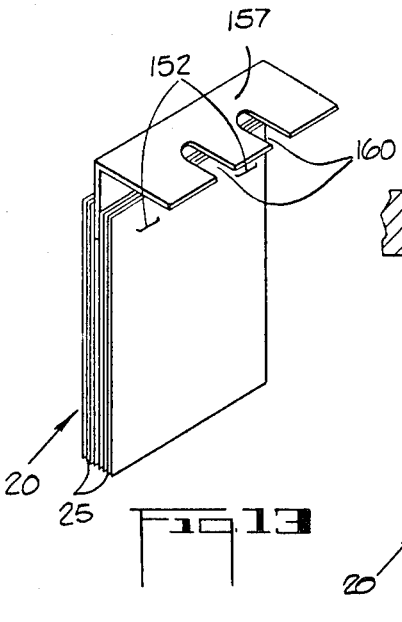
FIG. 13
FIG. 12
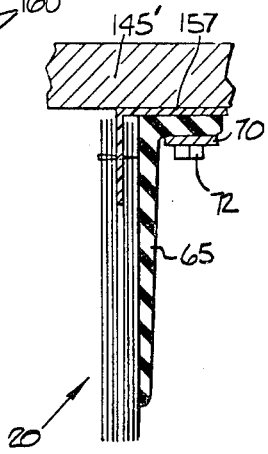
FIG. 14
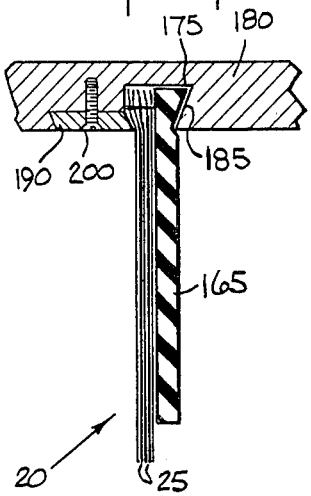
FIG. 16
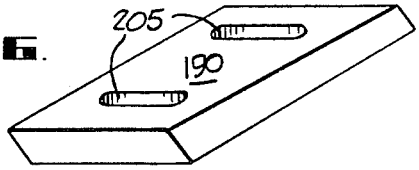
FIG. 15
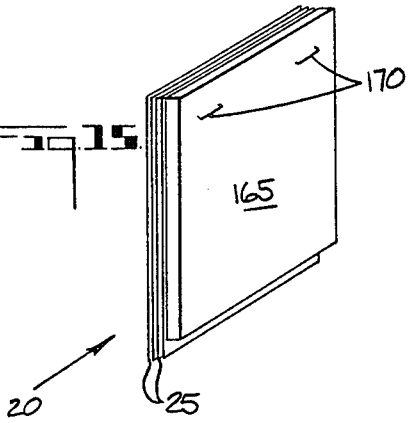

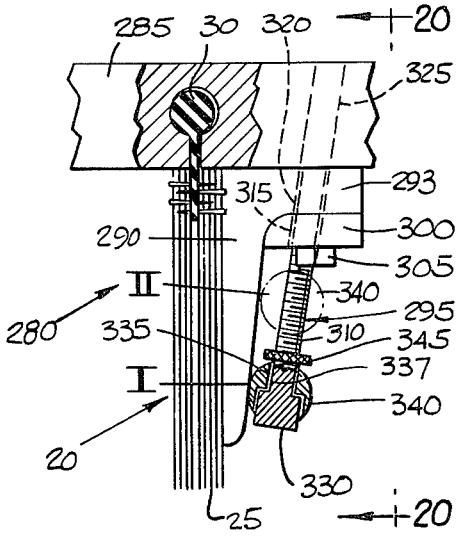
Fig. 19.
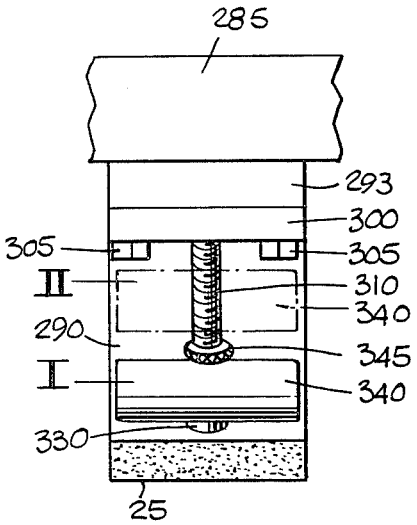
Fig. 20.
Fig. 21.
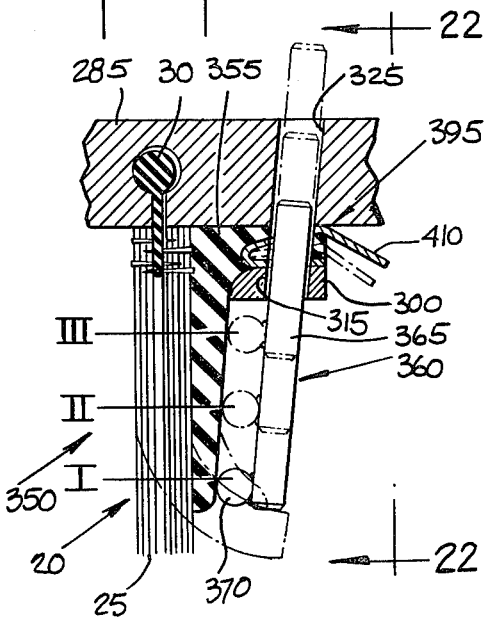
Fig. 22.
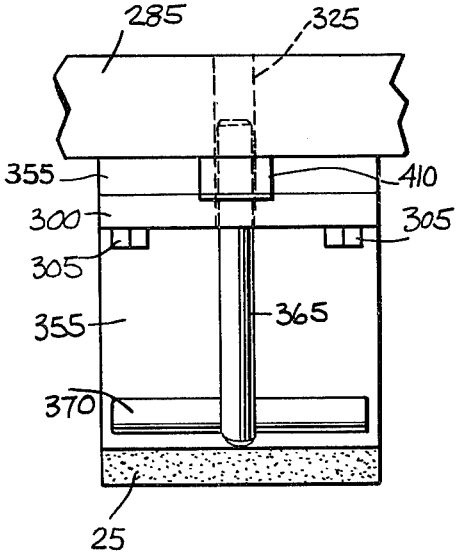

ABRADING TOOL

CROSS-REFERENCE TO RELATED APPLICATION

This application is a continuation-in-part of U.S. patent application Ser. No. 323,017 filed Nov. 19, 1981.

TECHNICAL FIELD

This invention relates to surface finishing apparatus and more particularly relates to a rotary abrading tool having sanding members adjustably biased towards the surface to be finished.

BACKGROUND OF THE INVENTION

Surface abrading apparatus or tools are exemplified by the use of one or more abrasive sanding members that are suitably mounted on a movable member. These apparatus have found great use in the abrading or finishing of surfaces, such as, for example, the surfaces of relatively roughly formed metal parts, etc. In use, the sanding members are forcibly applied to and moved across the surface to be finished or the work surface, whereby a smooth finish may be obtained.

However, prior attempts at finishing surfaces through abrasion do not facilitate the maintenance of a uniform sanding pressure on the work surface whereby the sanding members are all kept in continuous contact with the work surface. Furthermore, the prior art has not provided an abrading tool which aids in the control of the sanding pressure. Also, the prior art has failed to produce an abrading tool which increases the likelihood that all the sanding members simultaneously contact the work surface. A simultaneous contact will generate a multi-directional finish on the work surface minimizing the probability of creating undesirable uni-driectional striations. Finally, the prior art has not utilized an abrading tool which ensures that all the sanding members have a maximum contact with the work surface thereby decreasing the time necessary to obtain a smooth finish on the work surface.

The above-indentified application discloses an abrading tool obviating these disadvantages of the prior art. The tool comprises a rotatable support, a plurality of elongated abrasive elements and a plurality of flexible biasing springs adapted for mounting on the rotatable support. Each biasing spring is capable of forcing or biasing an associated abrasive element toward a position that is substantially perpendicular to the rotatable support. As a result, a uniform controllable sanding pressure, simultaneous work surface contact of the abrasive elements, minimization of striations on the work surface and reduction of sanding time are achieved.

Unfortunately, the abrading tool of the above-identified application has no provision for modifying the biasing force or stiffness of the flexible springs. A modification or an adjustment of the stiffness of one or more of the flexible springs would permit a change in the rate of removal of material from the work surface without any change in the speed of the rotatable support. The same feed rate and abrasive elements could also be used even though the material removal rate is changed. Finally, modifying the stiffness of an abrasive element would accomodate different work surface characteristics such as, e.g., type of material, surface roughness, etc.

SUMMARY OF THE INVENTION

Briefly the present invention provides an abrading tool comprising a rotatable support and at least one abrasive member carried by the rotatable support. A means for applying a biasing force upon the abrasive member is provided whereby the abrasive member is urged towards a position substantially perpendicular to the support. Finally, a means for adjusting the force of the biasing means is provided.

BRIEF DESCRIPTION OF THE DRAWINGS

The present invention will be more apparent from the following specification and drawings wherein:

FIG. 4 is a side view, with parts broken away, of a second embodiment of an abrading tool.

FIG. 5 is a plan view of the abrading tool of FIG. 4.

FIG. 11 is a cross-sectional view of another alternate embodiment for mounting an abrasive member and a flexible biasing spring.

FIG. 12 is a cross-sectional view of still another embodiment for mounting an abrasive member.

FIG. 13 is a perspective view of the abrasive member of FIG. 12.

FIG. 14 is a cross-sectional view of yet another embodiment for mounting an abrasive member and a flexible biasing spring.

FIG. 15 is a perspective view of the abrasive member and the biasing spring of FIG. 14.

FIG. 16 is an enlarged view of a portion of the mounting for the abrasive member and biasing spring of FIG. 14.

FIG. 19 is a partial cross-sectional view of an abrading tool having a first embodiment of an adjusting means of the present invention.

FIG. 20 is a view taken along line 20—20 in FIG. 19.

FIG. 21 is a partial cross-sectional view of an abrading tool provided with a preferred embodiment of an adjusting means of the present invention.

FIG. 22 is a view taken along line 22—22 in FIG. 21.

DETAILED DESCRIPTION OF THE INVENTION

Figure 2:
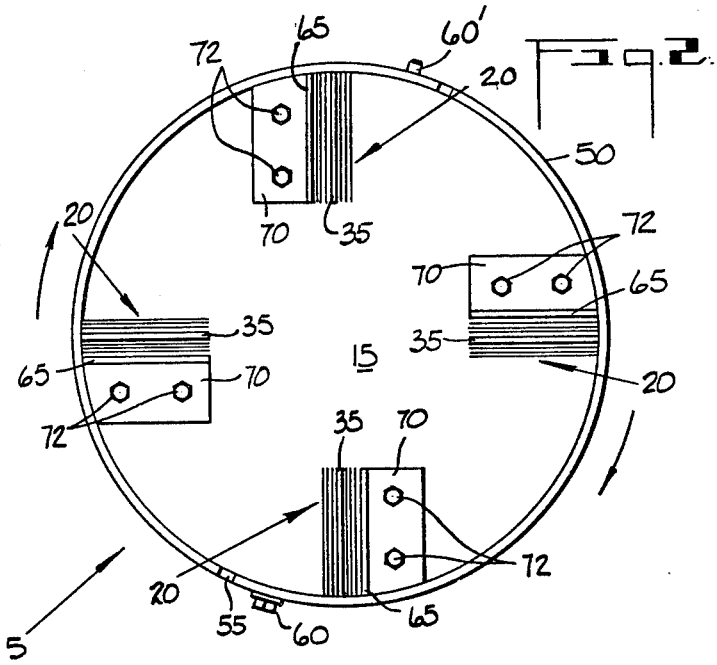
FIG. 2 is a plan view of the abrading tool of FIG. 1.
Figure 3:
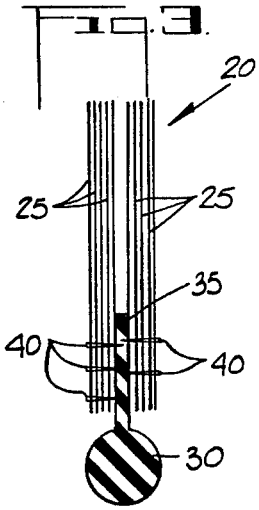
FIG. 3 is a cross-sectional view of an elongated abrasive member.
Figure 1:
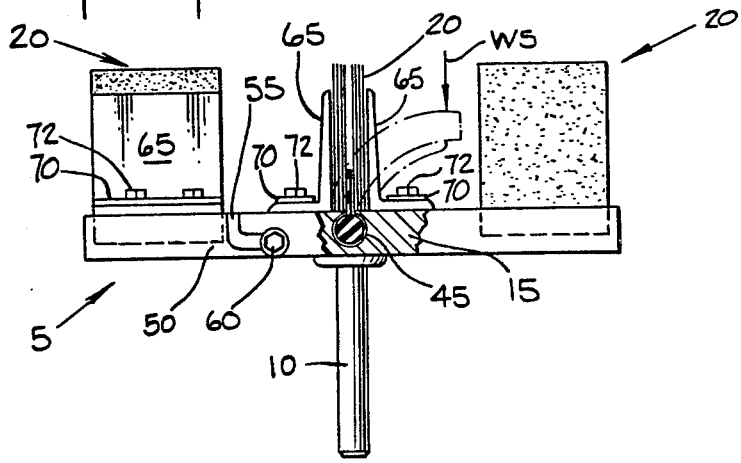
FIG. 1 is a side view, with parts broken away, of a first embodiment of an abrading tool.

Referring now to the drawings wherein like reference characters designate the same or similar parts throughout the several views and in particular to FIG. 1 which illustrates a sander assembly or an abrading tool 5 comprising a shaft 10 rotatable by an appropriate means such as a motor (not shown). The shaft 10 is suitably connected to a rotatable hub structure or a disc 15 forming a mounting surface or a support for one or more elongated abrasive members or sanding fingers 20. The abrasive members 20, illustrated in FIG. 3, are of generally conventional construction and are described in greater detail in U.S. Pat. No. 3,747,285, incorporated herein by reference.

As is shown in FIG. 3, each sanding finger 20 comprises a plurality of flexible abrasive leaves or sheets of sandpaper 25. Optionally, tines, chains or stiff brush abraders (not shown) may be substituted for the sandpaper sheets. A flexible key 30, having a stem 35, is juxtaposed in the center of the plurality of sheets 25 and is attached thereto by suitable fasteners such as staples 40. The key 30 is configured to be carried or insertable within a recess or a keyway 45 formed within the disc 15. The keyway 45 and all keyways referred to hereinafter, may be described as having a keyhole corss-sectional configuration in that a peripheral opening or entrance which is narrower in width than the maximum width dimensions of the keyway is provided (see, e.g., FIGS. 1, 4, 8 and 17).

A releasable constraining ring 50 circumscribes the rotatable disc 15 and provides a means for constraining the key 30 of each sanding finger 20 within its associated keyway 45 as the disc is rotated in use. The ring 50 is fastenable upon the disc 15 by means of a slot or a detent 55, formed on the ring 50, which cooperates in a known manner with a lockable bolt 60 threadingly engaging the disc 15. A pin 60′ lockably engages another detent 55′ (not shown in detail) opposite the detent 55. After inserting each key 30 in its associated keyway 45, the ring 50 is locked in place about the disc 15 by means of the locking bolt 60 and the pin 60′.

An elongated, L-shaped flexible spring 65, of elastomeric or metallic material, is carried by or fastened to the upper surface of the disc 15, proximate each of the sanding fingers 20, by any suitable means such as, for example, a clamping plate 70 and bolts 72. The spring 65 tends to bias or force the sanding finger 20 towards a substantially vertical position shown in FIG. 1, a position which is substantially perpendicular to the disc 15, for a purpose better understood hereinafter. As can be seen from the figures, the biasing spring 65 is shorter in length than a sanding finger 20 to not interfere with the sanding process.

During sanding of a work surface, represented by the arrow WS, each of the sanding fingers will tend to be forced into a flexed or a horizontal position (shown in phantom) by the work surface. However, the biasing spring 65 will maintain a constant spring force upon the sanding finger 20 which, if unresisted by the working surface, will tend to spring the sanding fingers into the vertical position shown in FIG. 1. As a result, the spring 65 biases the sanding finger against the work surface.

Another abrading tool 75 of the present invention is shown in FIG. 4 and differs from the embodiment shown in FIG. 1 through the use of a biasing compressible pad 80 mounted on or carried by the disc 15. The compressible pad 80 may be made of any suitable elastomeric material and is provided with a slot 85 allowing a sanding finger 20 to pass therethrough. As shown in FIG. 5, each slot 85 is contiguous to each sanding finger 20 but optionally may touch its associated sanding finger 20 to provide a quicker reacting biasing force. Another option (not shown) is to provide each sanding finger 20 with its own discrete compressible pad. With this last option a compressible pad would be placed adjacent a sanding finger 20 in order to aid the sanding finger in resisting any forces imposed on the finger by a work surface.

During use, each sanding finger is flexed as shown in phantom in FIG. 4 and pushed towards the rotatable disc 15 by the working surface (WS). However, the compressible pad 80 tends to resist the flexure of each sanding finger 20 by biasing each finger 20 towards a substantially vertical or perpendicular position (shown in solid in FIG. 4), i.e., towards the working surface.

As can be seen in FIG. 4, the outer portion of each sanding finger 20 has been rounded thereby facilitating the sanding of contoured surfaces or surfaces with small radii. However, the shape of each sanding finger 20 may be ascertained by criteria arising due to need and choice.

Figure 6:
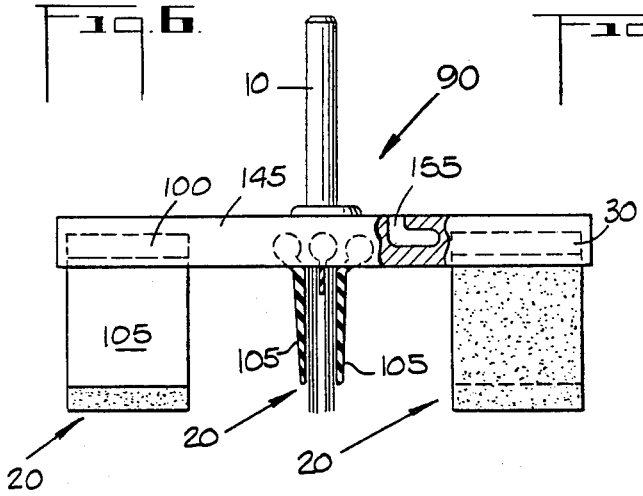
FIG. 6 is a side view, with parts broken away, of a third embodiment of an abrading tool.
Figure 8:
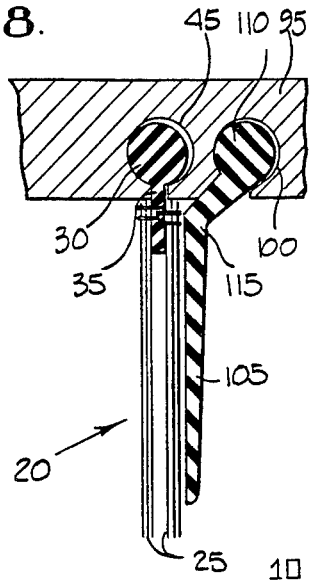
FIG. 8 is a cross-sectional view taken along line 8—8 of FIG. 7.
Figure 7:
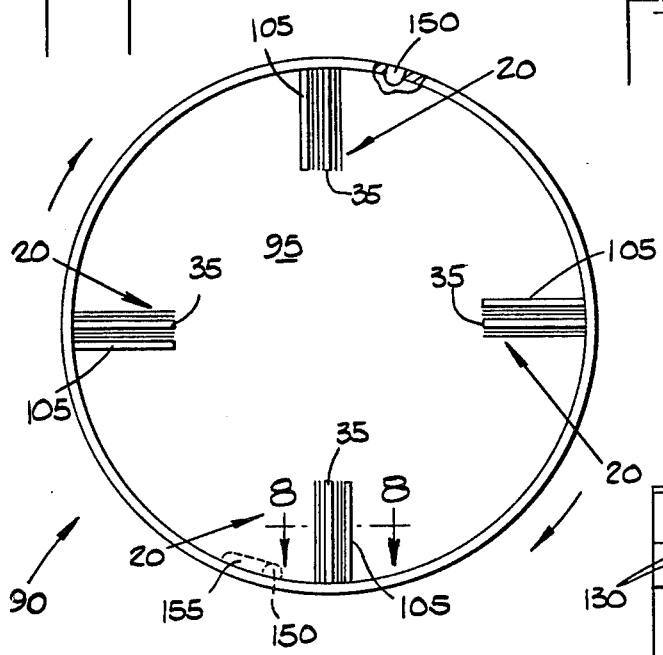
FIG. 7 is a plan view of the abrading tool of FIG. 6.

Referring now to FIG. 6, another embodiment of an abrading tool or a sander is designated as 90 and comprises a plurality of abrasive members or sanding fingers 20 carried by or mounted upon a rotatable disc 95. As is illustrated in FIG. 8, a sanding finger 20 comprises sheets of sandpaper 25. The sheets are stapled to a flexible key 30 configured to be insertable within a keyway 45.

Another keyway 100, formed within the disc 95, provides a mounting means for an elongated, flexible biasing spring 105 made of an elastomeric or metallic material and has an integral key 110 adapted to be insertable within the keyway 100. As shown in FIG. 8, the biasing spring 105 has a dog-leg stem 115 allowing the spring to be positioned contiguous the sanding finger 20.

In use, the sander 90 is pressed against a work surface to be finished thereby flexing the fingers 20. The spring 105 will tend to resist this flexure whereby the full benefits of the present invention may be obtained.

Figure 9:
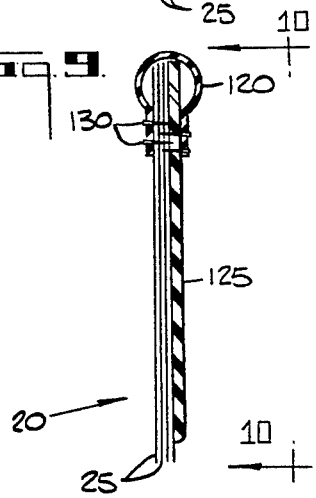
FIG. 9 is a cross-sectional view of an alternative embodiment for mounting an abrasive member and its associated flexible biasing spring.
Figure 10:
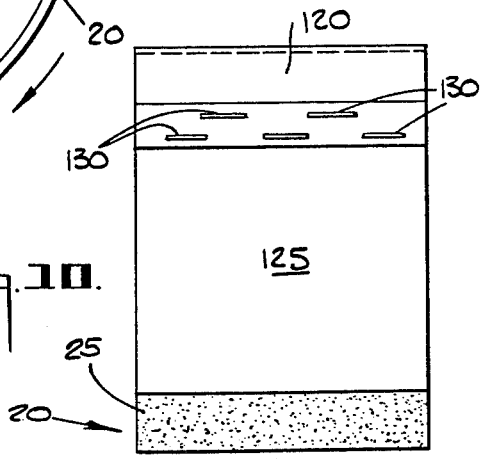
FIG. 10 is a plan view of the embodiment of FIG. 9.

FIGS. 9 and 10 illustrate another method of mounting a sanding finger and a biasing spring on a rotatable disc. In particular, FIG. 9 shows a sanding finger 20 configured to be positioned within a clip 120 of substantially circular cross section and constructed of any desired material such as metal or plastic. A substantially flat, elongated, flexible biasing spring 125 of suitable material is disposed proximate the sanding finger 20 and is clamped within the clip 120. A plurality of fasteners, such as, e.g., staples 130, fix the sanding finger 20 and the spring 125 within the clip 120 which is configured to insertable within a suitable keyway formed within a rotatable disc.

Referring now to FIG. 11, still another embodiment of a means for mounting a sanding finger and a flexible biasing spring within a rotatable disc is illustrated. The sanding finger 20 is fixedly clamped, using a plurality of staples 130, within a substantially semi-circular clip 120' fabricated out of any suitable material such as metal or plastic. A flexible biasing spring 125' is disposable adjacent the sanding finger 20 and is provided with a transition section 135 leading to a substantially semi-circular key section 140. Both the clip 120' acting as a key and the key section 140 of the spring 125' are configured to be insertable within a keyway, such as the keyway 45.

During use, the sanding fingers and the flexible biasing springs in each of the embodiments illustrated in FIGS. 8, 9 and 11 are constrained within their associated keyways within the rotatable disc 95 by means of a releasable constraining ring 145 circumscribing the disc 95. The ring 145 is attachable to the disc 95 by means of protrusions 150. The protrusions are formed on the inner surface of the ring 145 and are engagable with slots or detents 155 that receive and lock the protrusions in a known manner.

The releasable constraining ring is eliminated in the embodiments illustrated in FIGS. 12–18. For example, in FIG. 12, a sanding finger 20 and a flexible biasing spring 65 are shown mounted upon a rotatable disc 145'. The sanding finger 20, comprising the sandpaper sheets 25, is attached by means of staples 152 to a thin L-shaped mounting plate 157. The plate 157 is provided with a pair of slots 160 allowing the plate to be inserted under the spring 65. The bolts 72 pass through the slots 160 whereby when the bolts are tightened down against the clamping plate 70 the plate 157 is fixed between the spring 65 and the rotatable disc 145'.

In the embodiment of FIG. 14, a sanding finger 20 is conveniently fastened to an elongated, flat, flexible biasing spring 165 (constructed of suitable material) by means of a plurality of staples 170 (see FIG. 15). A portion of the sanding finger and the biasing spring are configured to be insertable within a recess 175 of a rotatable disc 180. The recess 175 has a wedging surface 185 which cooperates with an adjustable wedge 190 having a generally trapezoidal cross-section (see FIG. 16). Once the sanding finger 20 and the biasing spring 165 are inserted within the recess 175, the wedge 190 may be forced against the sanding finger 20 by tightening down on a pair of screws 200. The screws 200 pass through a pair of slots 205 in the wedge 19 and threadingly engage the disc 180. Forcing the wedge against the sanding finger 20 causes the sanding finger and the biasing spring 165 to be forced against the wedging surface 105 whereby the sanding finger 20 and the biasing spring 165 are clamped or fixed between the wedge 190 and the wedging surface 185.

Figure 17:
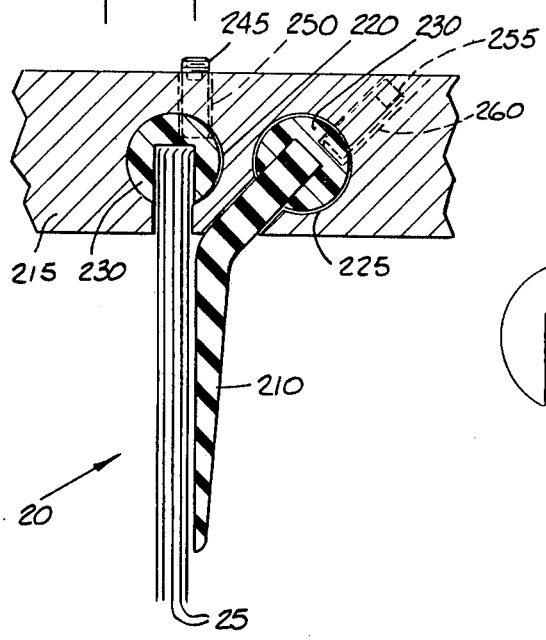
FIG. 17 is a cross-sectional view of a further embodiment for mounting an abrasive member and a flexible biasing spring.
Figure 18:
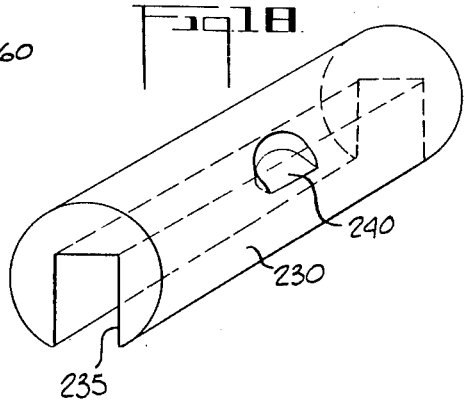
FIG. 18 is an enlarged perspective view of a portion of the mounting for the abrasive member and biasing spring of FIG. 17.

Referring now to FIG. 17, a sanding finger 20 and a flexible biasing spring 210 is shown as being carried or mounted on a rotatable disc 215. The sanding finger 20 and the biasing spring 210 are mounted in a keyway 220 and a keyway 225, respectively, by means of a tumbler clamp 230 configured to be insertable within the keyways 220, 225. As illustrated in FIG. 18, the clamp 230 comprises an elongated cylindrical body having a slot or an open-ended axial retainer channel 235 and a screw flat 240. The clamp 230 may be made of any suitable material such as, e.g., metal or plastic.

In use, the sanding finger 20 is inserted within the channel 235. The clamp 230 is then inserted within the keyway 220 whereafter a screw 245, threadably cooperating with a threaded hole 250 formed in the disc 215, may contact the screw flat 240. Turning in of the screw 245 imparts a torque on the clamp 230 whereby it is rotated and the sanding finger 20 is wedged or clamped within the keyway 220. In addition to enabling the clamp 230 to be rotated, the screw flat 240 acts as a constraint against axial movement of the clamp within the keyway 220.

The biasing spring 210, provided with a dog-leg stem allowing the spring to be positioned contiguous the sanding finger 20, may also be inserted into the channel 235 of a clamp 230. After the clamp 230 is inserted within the keyway 225, a screw 255, cooperating with a threaded hole 260, and the screw flat 240, can rotate the clamp 230 and lock the biasing spring 210 within the keyway 225.

The above-described embodiments of an abrading device or a sander allow the abrasive or sanding members to maintain a uniform contacting pressure on a work surface. The uniform pressure is substantially provided by the flexible biasing springs forcing the sanding members to keep in contact with the work surface to be sanded or finished. The biasing means also allows all sanding members to simultaneously contact the work surface. A simultaneous contact generates a multi-directional finish on the work surface thereby minimizing the probability of creating undesirable striations. Minimization of striations reduces the amount of any subsequent hand work to be performed on the work surface. Since the sanding members are biased towards the work surface, the sanding members have increased surface contact with the work surface. Consequently, sanding time using the above sanders is decreased compared to the sanders of the prior art assuming that substantially the same operating rotary speeds and pressures are applied during sanding. Finally, the control of the sanding pressure or the pressure applied against the work surface is facilitated during use of the above sanders. This advantage is obtained by controlling the spring constant of the biasing springs through proper design and experimentation. As will be obvious to the skilled artisan, the spring constant of a biasing spring largely determines the biasing force of the biasing spring or its ability to urge a sanding member towards a position which is substantially perpendicular to the rotatable disc.

When it is desired to modify or adjust the biasing force of a biasing spring, an abrading tool 280 of the present invention may be utilized (see FIG. 19). The abrading tool 280 comprises one or more sanding fingers 20, a rotatable support or a disc 285, a flexible biasing spring 290 of a fixed spring constant, determined by the elastomeric material from which it is made, and a biasing spring force adjusting means or an adjuster 295 of the present invention.

The elastomeric flexible biasing spring 290 is suitably attached to the disc 285 by means of a plate 300 and a pair of bolts 305 threadingly engaging the disc 285 whereby the mounting flange 293 of the spring 290 may be clamped to the disc 285. The sanding finger 20 comprises a plurality of sheets of sandpaper 25 attached to a key 30 insertable within a keyway formed within the disc 285.

The biasing spring force adjusting means 295 comprises an elongated member or a rod 310 having a threaded shank engaging a threaded bore 315 in the clamping plate 300. The rod 310 is capable of translation or movement within a passageway 320 formed in the mounting flange 293 of the biasing spring 290 and through an open-ended bore or a passageway 325 disposed in the disc 285. The rod 310 is provided with an enlarged end 330 cooperating with a recess 335 and a bore 337 extending through a transverse member or a bar 340 capable of being positioned to abuttingly contact the biasing spring 290 along the length of the biasing spring 290. A retainer 345 threadingly engages the shank of the rod 310 whereby the bar 340 is constrained proximate the end 330 of the rod 310.

As will be clear to the skilled artisan, as the rod 310 is rotated, the end 330 either moves toward the rotatable disc 285 or away from the disc. Concomitently, the transverse bar 340 abuttingly contacts the biasing spring 290 at different points along its length, e.g., at points I or II. As will be clear, the stiffness of the biasing spring 290 or the capability of the biasing spring 290 to impart a force or urge the sanding member 20 towards the position which is substantially perpendicular to the rotatable disc 285 decreases from point I to point II. At point I the biasing force of the biasing spring 290 is the greatest and will enable a user to remove the greatest amount of material from the work surface. As the transverse bar 340 is moved from point I to point II, changes in the material removal rate, without a change in the speed of the rotatable disc 285, feed rate or sandpaper 251, may be effectuated.

Referring now to FIG. 21, a more preferred embodiment of an adjuster of the present invention is illustrated. The abrading tool 350 of FIG. 21 comprises one or more sanding fingers 20 suitably attached to the disc 285. A biasing spring 355 is clamped to the disc 285 by means of the clamping plate 300 and the threaded bolts 305. An adjuster 360 is disposed proximate the spring 355.

Figure 23:
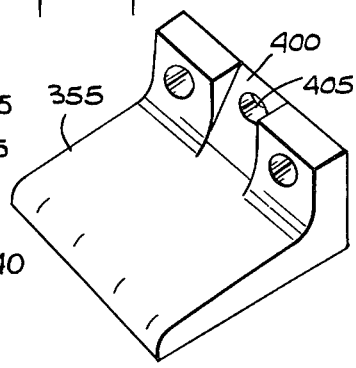
FIG. 23 is a perspective view of a flexible biasing spring useful with the embodiment shown in FIG. 21.
Figure 27:
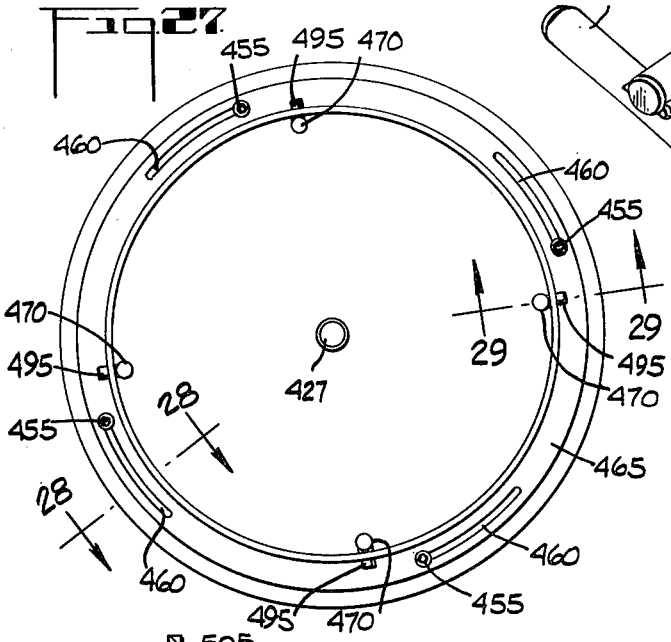
FIG. 27 is a plan view of the embodiment of FIG. 26.
Figure 25:
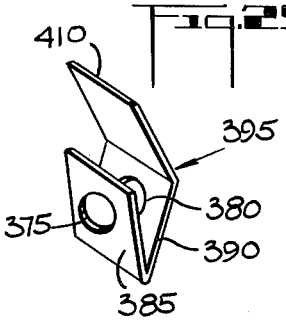
FIG. 25 is an enlarged perspective view of a spring latch useful with the adjusting mean illustrated in FIG. 21.
Figure 28:
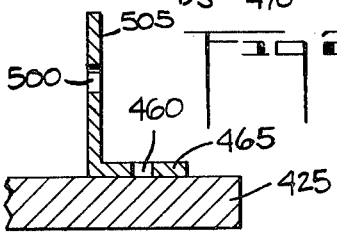
FIG. 28 is a view taken along line 28—28 in FIG. 27.
Figure 29:
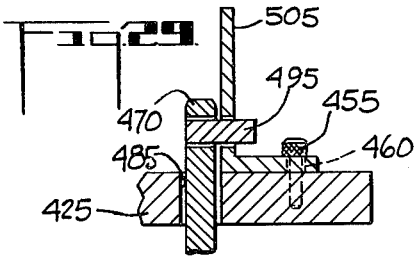
FIG. 29 is a partial veiw taken along line 29—29 in FIG. 27.

The adjuster 360 comprises an elongated member or a rod 365 and a transverse member or a bar 370 attached at one end of the rod 365. The other end of the rod 365 is capable of movement through the bore 315 formed within the clamping plate 300 and a pair of bores 375 and 380 formed in a pair of flanges 385 and 390, respectively, of a releasable elastic spring latch 395 (see FIG. 25). The spring latch 395 is adapted to be received within a recess 400 (see FIG. 23) formed within the mounting flange of the biasing spring 355, and is constrained therein by the clamping plate 300. The spring latch 395 frictionally engages the rod 365 (see FIG. 21) to lock the rod 365 in a desired position or location. The recess 400 is provided with a bore 405 allowing passage of the rod 365 into the open-ended passageway 325.

Figure 24:
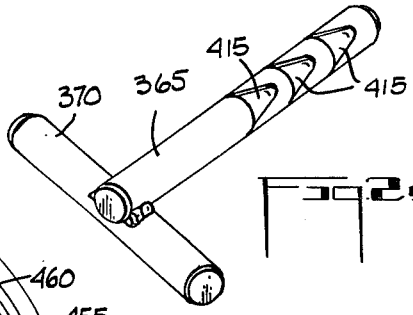
FIG. 24 is an enlarged perspective view of a portion of the adjusting means shown in FIG. 21.

In use, the bar 370 of the adjuster 360 may be positioned at various locations along the biasing spring 355, e.g., positions I, II and III, by depressing a release tab 410 integrally formed on the spring latch 395 (shown in phantom in FIG. 21). Of course, as the bar 370 is moved from or along positions I, II and III, the other end of the rod 365 is translated into and through the open-ended passageway 325, as shown in phantom in FIG. 21. Optionally, a plurality of notches or indentations 415 (see FIG. 24) may be formed on the shank of the rod 365 to enable the spring latch 395 to more readily engage and lock the rod 365.

As will be clear to the skilled artisan, when the transverse bar 370 is moved along the biasing spring 355, the biasing force and thus the capability of a biasing spring 355 to urge the sanding finger 20 towards the position which is substantially perpendicular to the disc 285, is changed or modified without a change in the feed rate of the abrading tool 350 of the rotatable speed of the disc 285 or a change in the material of the sanding finger 20. If it is desired to change the biasing force on each biasing spring simultaneously, the embodiment illustrated in FIG. 26 is preferred.

Figure 26:
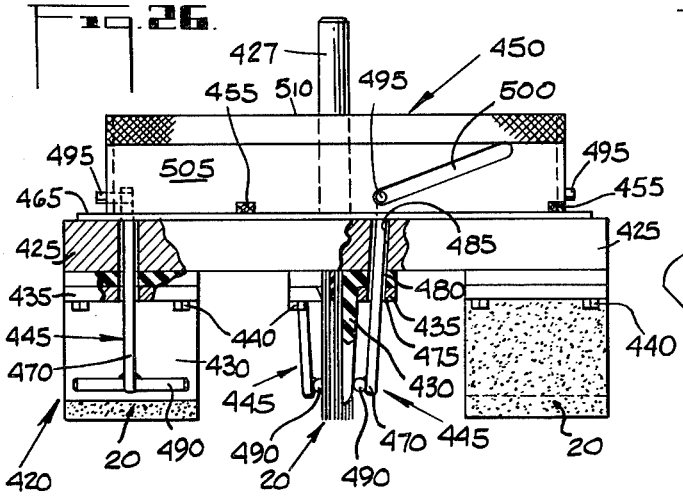
FIG. 26 illustrates an apparatus for simultaneously manipulating a plurality of adjusting means of the present invention.

In FIG. 26 an abrading tool 420 is shown as comprising a rotatable disc 425 provided with a rotatable shaft 427 capable of being coupled to a rotatable drive means (not shown). A plurality of sanding fingers 20 are suitably attached to the disc 425 and are constrained thereupon by a releasable ring (not shown). A plurality of biasing springs 430 are each attached to the disc 425 as by a clamping plate 435 and bolts 440 threadingly engaging the disc 425. Each biasing spring is provided with a means for adjusting the biasing force of the biasing spring or an adjuster 445. Finally, the abrading tool 420 comprises a cam ring 450 for simultaneously manipulating each adjuster 445. The cam ring 450 is carried on the disc 425 by means of lock screws 455 inserted in slots 460 formed on the flange 465 of the cam ring 450.

Each adjuster 445 comprises an elongated rod 470 capable of passing through bores 475, 480 and 485 respectively formed in the plate 435, the mounting flange of the spring 430 and in the rotatable disc 425. A transverse bar 490 is suitably attached at one end of the rod 470 and is capable of being positioned to abuttingly contact the biasing spring 430 along its length. At the other end of the rod 470 an outwardly disposed pin 495 is inserted within an upwardly inclined slot 500 formed in the perpherial side wall 505 of the cam ring 450.

Before it is desired to manipulate the adjusters 445 each lock screw 455 is unloosened allowing the cam ring 450 to be rotated. Upon rotation of the ring 450, facilitated by a knurled upper edge 510, each pin 495 will be forced upwardly within each slot inducing a translation of each rod 470. Concomitently, the biasing spring contact points of each transverse bar 490 will be modified or changed whereby the biasing force of the biasing spring 430 is adjusted.

In each embodiment of the present invention described above a modification of the sanding finger stiffness is achieved through a modification of the biasing force of each biasing spring. A modification of the biasing force enables each of the abrading tools of the present invention to accommodate different work surface properties and permits an operator of the tool to obtain changes in the material removal rate from the work surface without changing the speed of the rotatable disc, the feed rate of the abrading tool or the abrading media or material of the sanding finger.

The above described embodiments are illustrative of the invention which may be modified within the scope of the appended claims.

What is claimed and desired to be secured by Letters Patent of the United States is:

1. An abrading tool, comprising:

a rotatable support having at least one bore, at least one abrasive member carried by said support, means for applying a biasing force upon said abrasive member to urge said abrasive member towards a position which is substantially perpendicular to said support, said biasing means having a recess;

a passageway extending through said biasing means, said passageway being coaxially aligned with said bore;

means for adjusting the force of said biasing means, said adjusting means comprising an elongated member having a transverse member capable of abuttingly contacting said biasing means along its length, said elongated member being translatable within said passageway and said bore, and means for constraining said elongated member, said constraining means comprising a releasable flexible latch spring disposed in said recess, said latch spring being capable of engaging said elongated member, whereby when said latch spring is released said elongated member may translate within said passageway and said bore to position said transverse member at different locations along said biasing means to vary the biasing force imposed on said abrasive member.

2. The tool of claim 1, further comprising a plurality of indentations formed on the surface of said elongated member, said latch spring being capable of engaging said indentations.

3. The tool of claim 1, further comprising means for clamping said biasing means to said support and for clamping said latch spring within said recess, said latch spring being disposed about said elongated member.

4. An abrading tool for providing a planar surface with a smooth finish, comprising:

a support having a mounting face capable of being presented to said surface, said support being rotatable about an axis that is perpendicular to said face;

a plurality of abrasive members capable of being mounted upon said support, means for mounting each abrasive member substantially perpendicular to said face whereby each abrasive member extends along said axis, An L-shaped, flexible biasing means for urging each abrasive member towards a position that is substantially perpendicular to said mounting face, said biasing means extending substantially along the length of said abrasive member, and means for adjusting the force of said biasing means, said adjusting means comprising a passageway extending through the base of said biasing means, a bore formed in said support and being coaxially aligned with said passageway, an elongated member, said elongated member having a transverse member disposed at one end thereof and being capable of abuttingly contacting said biasing means, said elongated member being translatable within said passageway and said bore, means for constraining said elongated member, said constraining means being capable of allowing said elongated member to translate and thereby position said transverse member at different locations along the length of said biasing means whereby the biasing force imposed on said abrasive member by said biasing means may be varied.

5. The tool of claim 4, further comprising a recess formed in the base of the said biasing means, said constraining means comprising a flexible latch spring disposed in said recess, said flexible spring being capable of releasably engaging said elongated member.

6. The tool of claim 5, further comprising a plurality of indentations formed on the surface of said elongated member, said flexible spring being capable of releasably engaging said indentations.

7. The tool of claim 6, further comprising means for clamping said biasing means to said support and for clamping said flexible spring within said recess.

8. The tool of claim 4, further comprising means for attaching said biasing means to said support, said attaching means having a threaded bore coaxial with said passageway, said transverse member having means forming a receptacle for rotatably retaining said one of said elongated member, said elongated member being provided with threads capable of engaging said threaded bore whereby when said elongated member is rotated it translates and urges said transverse member to contact said biasing means at different locations along its length thereby varying the biasing force imposed on said abrasive member by said biasing means.

9. The tool of claim 4, wherein said elongated member extends through said passageway and said bore, said elongated member having a pin disposed at its other end, means inducing a translation of said elongated member, said translation inducing means comprising a releasable cam ring, means rotatably mounting said cam ring to said support, said cam ring having an upwardly inclined slot engageable by said pin, whereby when said cam ring is rotated said elongated member is translated and said transverse member contacts said biasing means at different locations.

* * * * *